US010639921B2

(12) United States Patent
Askeland et al.

(10) Patent No.: US 10,639,921 B2
(45) Date of Patent: May 5, 2020

(54) TRANSFER PRINTING

(71) Applicant: Hewlett-Packard Development Company, L.P., Houston, TX (US)

(72) Inventors: Ronald A. Askeland, San Diego, CA (US); Dheya M. Alfekri, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/098,107

(22) PCT Filed: Jul. 26, 2016

(86) PCT No.: PCT/US2016/044078

§ 371 (c)(1),
(2) Date: Oct. 31, 2018

(87) PCT Pub. No.: WO2018/022018

PCT Pub. Date: Feb. 1, 2018

(65) Prior Publication Data

US 2019/0143727 A1 May 16, 2019

(51) Int. Cl.
*B41M 5/025* (2006.01)
*B41J 2/005* (2006.01)
(Continued)

(52) U.S. Cl.
CPC ..... *B41M 5/0256* (2013.01); *B41J 2/0057* (2013.01); *B41J 3/407* (2013.01); *B41J 11/002* (2013.01); *B41J 11/0015* (2013.01); *B41M 5/0064* (2013.01); *B41M 7/009* (2013.01); *B41M 7/0054* (2013.01); *B41M 2205/10* (2013.01); *B41M 2205/40* (2013.01)

(58) Field of Classification Search
CPC ..... B41J 2/2107; B41J 11/002; B41J 2/0057
USPC ..... 347/101–103
See application file for complete search history.

(56) References Cited

U.S. PATENT DOCUMENTS 4,527,171 A * 7/1985 Takanashi ..... B41J 2/325 101/470
5,891,562 A 4/1999 Prodiktion
(Continued)

FOREIGN PATENT DOCUMENTS

CN 202053674 11/2011
CN 102958698 3/2013
(Continued)

OTHER PUBLICATIONS

Unknown, "Inking System", PrintWiki, May 23, 2016, 5 pages, < http://printwiki.org/Inking_System >.
(Continued)

*Primary Examiner* — An H Do
(74) *Attorney, Agent, or Firm* — HP Inc. Patent Department

(57) ABSTRACT

Examples described herein include printing systems that include a transfer medium, a binder material applicator to apply a layer of binder material to a surface of the transfer medium, and a print engine to apply printing material to the layer of binder material. The system can also include a roller to press the transfer medium against a print medium to transfer the binder material and the printing material to the print medium.

15 Claims, 6 Drawing Sheets

(51) Int. Cl.

| | |
|---|---|
| ***B41J 11/00*** | (2006.01) |
| ***B41M 5/00*** | (2006.01) |
| ***B41M 7/00*** | (2006.01) |
| ***B41J 3/407*** | (2006.01) |

(56) References Cited

U.S. PATENT DOCUMENTS

| | | | | |
|---|---|---|---|---|
| 6,082,257 | A | 7/2000 | Secor | |
| 6,240,639 | B1 | 6/2001 | Hycner | |
| 6,887,558 | B2 | 5/2005 | Simpson et al. | |
| 6,908,240 | B1 | 6/2005 | Johnson et al. | |
| 8,342,672 | B2 * | 1/2013 | Yamashita | B41J 11/002 347/101 |
| 2003/0068571 | A1 | 4/2003 | Uehara et al. | |
| 2010/0073448 | A1 | 3/2010 | Ikuno et al. | |
| 2013/0127965 | A1 | 5/2013 | Kushida et al. | |
| 2015/0097906 | A1 | 4/2015 | Beier et al. | |
| 2015/0174887 | A1 | 6/2015 | Moorlag et al. | |
| 2015/0251409 | A1 | 9/2015 | Ohnishi | |
| 2016/0144634 | A1 | 5/2016 | Emamjomeh et al. | |
| 2017/0090327 | A1 * | 3/2017 | Shimazu | G03G 15/0131 |

FOREIGN PATENT DOCUMENTS

| | | |
|---|---|---|
| CN | 203210832 | 9/2013 |
| EP | 1177912 A2 | 2/2002 |
| JP | 2010-076237 | 4/2010 |
| JP | 2014-069478 | 4/2014 |

OTHER PUBLICATIONS

Johnson, J., Aspects of Flexographic Print Quality and Relationship to Some Printing Parameters, 2008, 108 pages.

* cited by examiner

TRANSFER PRINTING

BACKGROUND

Various types of printing materials can be applied to a print medium to generate vibrant and colorful printed images. To produce a durable image on a nonporous print medium, such as plastics and vinyls, some printing systems mix different types of binders or solvents with the ink or pigments. When the binders set or the solvents evaporate, the applied printing material is permanently adhered to the print medium. While material properties of such binders and solvents are useful in generating durable printed image, the same properties can also cause complications in the associated print engines, such as inkjets printheads. Without constant time-consuming maintenance procedures, the print engines used to deposit the mixtures of binders and ink can quickly become clogged or otherwise inoperable.

DETAILED DESCRIPTION

Figure 1:
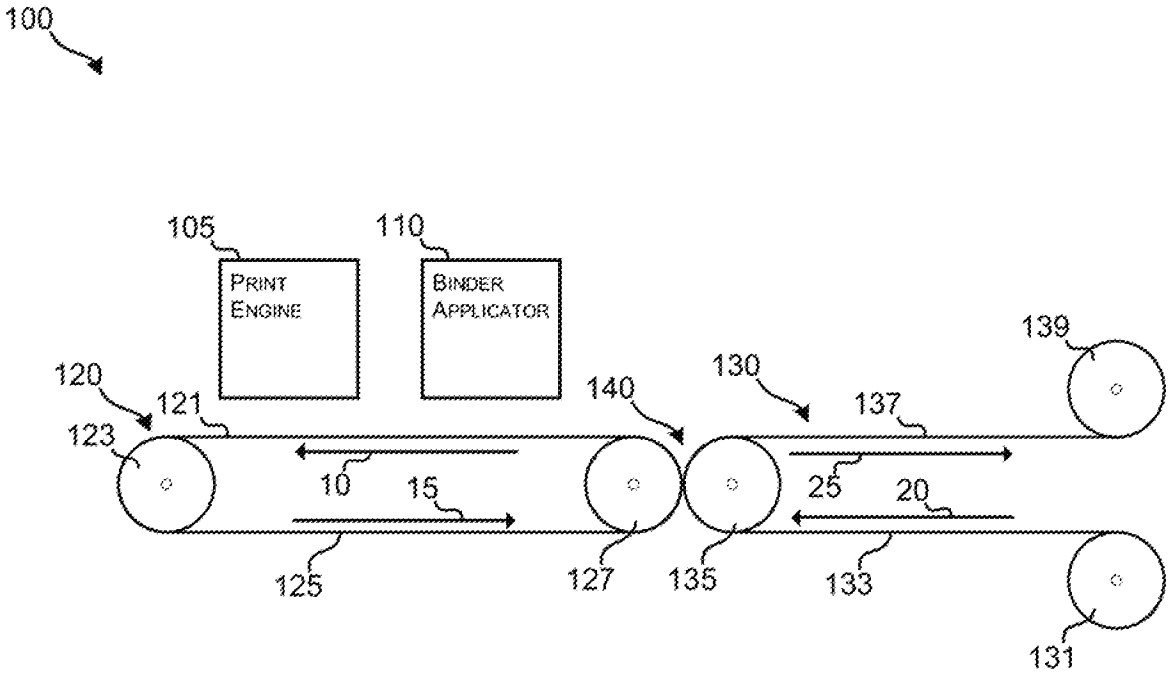
FIG. 1 depicts a schematic representation of an example belt type intermediate transfer printing system.

In various scenarios it is useful to print with printing materials that can durably adhere to smooth or non-porous materials, such as plastic, vinyl, acrylic, and the like. To aid pigments and inks to adhere to such materials, they can be mixed with various binder agents. While such binder agents include many physical, chemical, and material properties that help the pigments or inks adhere to non-porous surfaces, those same properties can cause problems in the printing mechanisms that are used to apply the ink-binder agent mixture. For example, in print engines that use an array of inkjets, the orifices of the inkjets can quickly become clogged or crusted and greatly diminish print quality. Accordingly, many systems that use an inkjet array to apply ink-binder agent mixtures also include expensive and time consuming cleaning mechanisms and routines to prevent the orifices from becoming clogged. In many scenarios, cleaning the print head may occur as frequency as once every few seconds, which can greatly decrease the throughput of such systems.

To avoid the clogging and cleaning issues associated with applying the ink-binder agent mixtures, the concentration of the binder agent in the mixture can be reduced. However, reducing the concentration of the binder agent can often have the undesired effect of reducing the durability and the resulting printed image. As such, implementations of the present disclosure include methods, apparatuses, and systems for first applying a layer of binder agent or material to an intermediate transfer medium, such as a reusable transfer blanket or single-use transfer film, and then applying a printing material with a low or no binder agent concentration to the layer of binder material. The stack of binder material and printing material can then be transferred to a desired print medium (e.g., a sheet of vinyl, plastic, or similar non-porous substrate) by pressing the transfer medium against the print medium. The interaction of the printing material and the binder material can help the ink adhere to the surface of the print medium with the added benefit that the now inverted layer of binder agent can form a more durable coating over the print material and the surface of the print medium.

In various implementations, the transfer material can include material properties that provides for release from the intermediate transfer medium to the print medium. The material properties of the transfer material may also include properties or chemical characteristics that interact with the printing material to generate durable printed images. For example, the transfer material can include a binder material that coats the printing material or mixes or interacts with the printing material on the surface of the print medium. The mixture or interaction of the binder material and printing material can aid in the adhesion or fixation of the printing material to the print medium. In some implementations, the order of application of the transfer material and of the printing material to the intermediate transfer layer and the subsequent transfer of those materials to the print medium allow for the transfer material to form an overcoat over the transferred printed image.

The transfer medium can include any form of reusable or disposable layers of material that are conducive to accepting binder material and printing material, and subsequently releasing all materials when presented or pressed against the print medium. For example, in implementations in which the transfer medium is a reusable blanket, the same surfaces can be repeatedly used to accept layers of binder material and printing material for transfer to a print medium. The reusable blanket can include various flexible combinations of plastics, rubbers, polymers, and the like that can either rotate around rollers or a drum during the binder material and printing material deposition processes and transfer to the print medium. In other implementations, a thin film or layer of single use or disposable transfer medium can be fed into the various systems described herein for use as the intermediate transfer medium. Such thin films or layers can be previously formed and stored in a supply spool, run through the system to generate the printed image as described herein, and then gathered in a collection spool as waste. In other implementations, the thin films or layers can be formed on demand by melting solids (e.g., in the form of plastic pallets, discs, shavings, etc.) into a thin film that can be used as the intermediate transfer medium and the various implementations described herein. In such implementations, the thin film can be formed and provided by an in situ film extruder.

In such implementations in which the binder material is included on or applied to the transfer medium, the concentration of binder materials in the printing material, such as inks or fluidic pigments, can be reduced. As such, print engines that use printing materials with reduced concentrations of binder materials require less maintenance or in-line cleaning. Implementations according to various examples of the present disclosure can greatly increase the reliability and throughput of print engines used to apply printing material that is bound to a print medium with the aid of a binder material. Examples of the present disclosure can be implemented using print engines that include scanning inkjet print heads or page wide arrays (PWA) of inkjet print heads with increased reliability.

FIG. 1 depicts an example system 100 according to various implementations of the present disclosure. As shown, system 100 can include an intermediate transfer medium 120 on which the binder applicator 110 can deposit a layer of binder material and a print engine 105 that can selectively apply printing material to generate a printed image on top of the layer of binder material. In the particular example shown, the intermediate transfer medium 120 is implemented as a blanket or belt disposed around rollers 123 and 127. As such, the surface of the intermediate transfer medium 120 can rotate about the rollers 123 and 127 to present different regions of the surface of the intermediate transfer medium 120 to the binder applicator 110 and/or the print engine 105. For example, the intermediate transfer medium 120 can move in the directions indicated by arrows 10 and 15. In such examples, various regions or areas of the surface of the intermediate transfer medium 120, as it moves in the direction indicated by arrow 10, can be presented first to the binder applicator 110 and then to the print engine 105. As described herein, the binder applicator 110 can include any type of digital or analog binder application mechanism, such jets, sprayers, rollers, and the like. The print engine 105 can include various types of ejection printheads, such as piezoelectric and thermal inkjets, sprayers, electrophotographic print engines, and the like.

Once the binder material and the printing material are applied to the surface of intermediate transfer medium 120, regions 125 of the surface of the intermediate transfer medium 120 on which binder material and printing material there are applied can move along the direction indicated by arrow 15 to be presented to and pressed against the print medium 130 in the nip 140.

In some implementations, the regions 121 and/or 125 of the intermediate transfer medium 120 can be exposed to various heating elements, such as conductive, inductive, and convection type heating mechanisms to set or semi-set the layer of binder material and the patter of printing material to a temperature and/or level of tackiness to provide for a clean release from the intermediate transfer medium 120 and transfer to the print medium 130.

The print medium 130, represented in the particular example of FIG. 1 as a web or spool of printing material can be supplied by spool 131, wrap around roller 135, and then be gathered on take-up spool 139, while moving in the directions of arrows 20 and 25. In the example configuration depicted in FIG. 1, the region 133 can represent the unprinted or untreated surface of the print medium 130 after it is unwound from supply spool 131. The region 137 can represent the printed or treated surface of the print medium 130 before it is gathered on the take-up spool 139. In some implementations, roller 135 can include mechanical, hydraulic, or pneumatic elements that can apply forces to generate pressure in the nip 140 between the roller 127 and the roller 135 to press the intermediate transfer medium 120 and the print medium 130 against one another. In various example implementations, the pressure exerted on the intermediate transfer media 120 and the print medium 130 in the nip 140 can cause the binder material and printing material deposited on the intermediate transfer medium 120 to transfer to the print medium 130.

The region 121 of the intermediate transfer medium 120 disposed proximate to the binder applicator 110 can receive the layer of binder material. As used herein, the term "binder material" can refer to any material that includes material, physical, or chemical properties that can interact with the material, physical, or chemical properties of the printing material applied by the print engine 105. In some implementations, the interaction between the binder material and the printing material can provide for improved or durable adhesion to the print medium 130. In addition, the term "binder material" may also refer to any material that includes material, physical, or chemical properties that allow for easy release from the intermediate transfer medium 120 when presented with a suitable printing medium 130 under corresponding conditions (e.g., temperature, pressure, etc.). As such, the combination of the binder material and printing material applied by the binder applicator 110 and the print engine 105 can be easily and durably transferred from the intermediate term medium 120 to the print medium 130 by pressing the two together in the nip 140 formed between the rollers 127 and 135.

Figure 2:
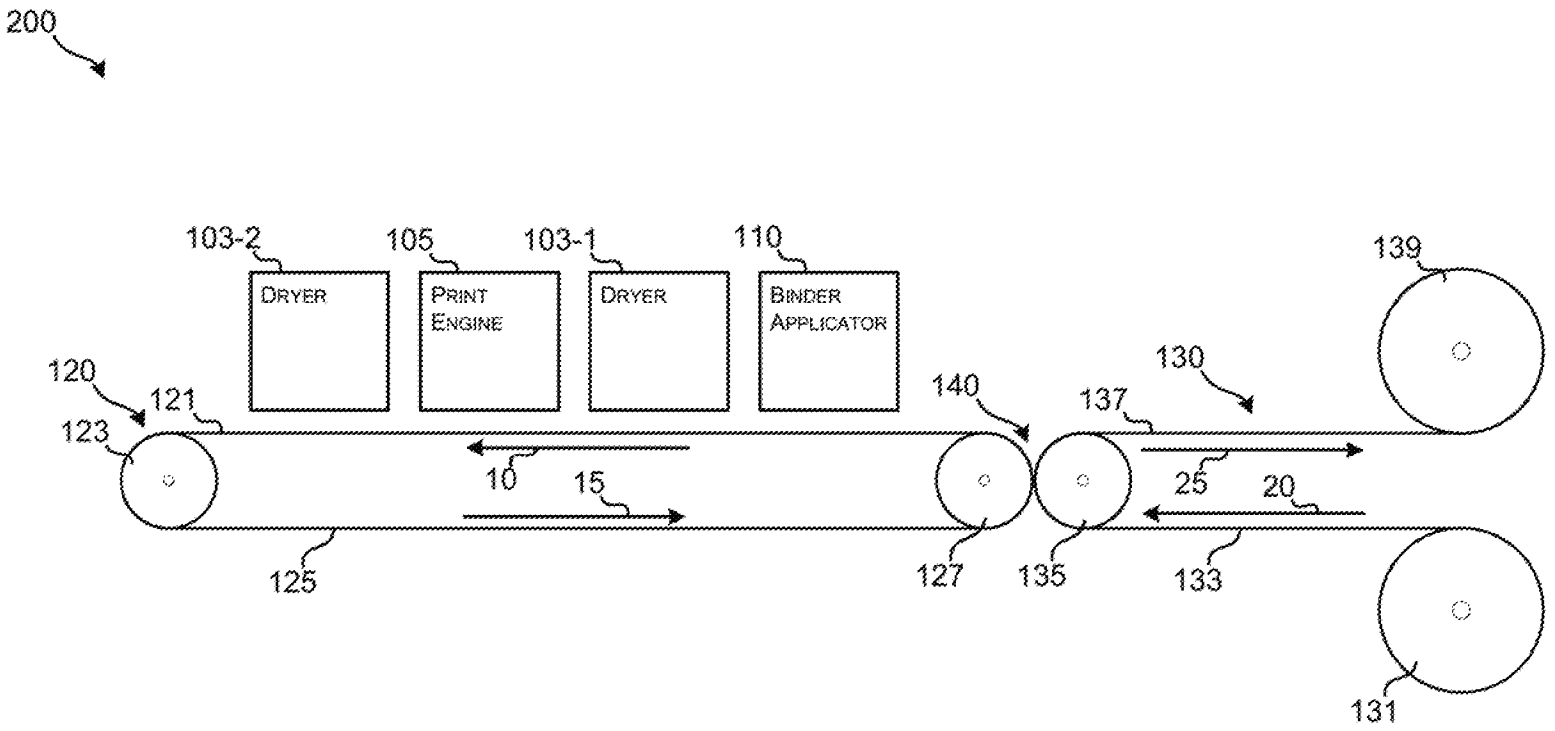
FIG. 2 depicts a schematic representation of another example belt type intermediate transfer printing system.

FIG. 2 depicts an example system 200 according to various implementations of the present disclosure. As illustrated, system 200 is similar to the example printing system 100 depicted in FIG. 1 but with the addition of dryers 103 disposed in various locations along the path of the intermediate transfer medium 120. In the particular example shown, one dryer 103-1 can be disposed downstream from the binder applicator 110. Accordingly, the dryer 103-1 can dry or otherwise set the layer of binder material applied by the binder applicator 110 to a level of dryness or firmness compatible with the printing material and application method of the print engine 105. For example, in implementations in which the print engine 105 includes a page wide array (PWA) inkjet print head, the dryer 103-1 may apply a treatment to the binder material disposed on the intermediate transfer medium 120 so that the binder material, while no longer wet, is still tacky and able to interact and/or combine with the printing material applied by the print engine 105.

A second dryer 103-2 can be disposed downstream from the binder applicator 110, the dryer 103-1, and the print engine 105 to apply a drying, heating, or other treatment to the layers of binder material and/or printing material disposed on the intermediate transfer medium 120. As described herein, the dryer 103-2, alone or in combination with another dryer 103-1, or another dryer not shown, can condition both the pattern of printing material that forms a printed image and the layer of binder material so that both materials cleanly release from the intermediate transfer medium 120 and neatly transfer to the print medium 130 when pressed together at the nip 140 between the rollers 135 and 127. The particular arrangements of the binder applicator 110, the dryers 103, and the print engine 105 is only one example arrangement possible according to the present disclosure. In other example implementations, there may be more or fewer dryers 103, print engines 105, and binder applicators 110 than depicted in FIG. 1 or 2. For example, the dryers 103 can be disposed proximate to the region 125 of the intermediate transfer medium 120.

Figure 3:
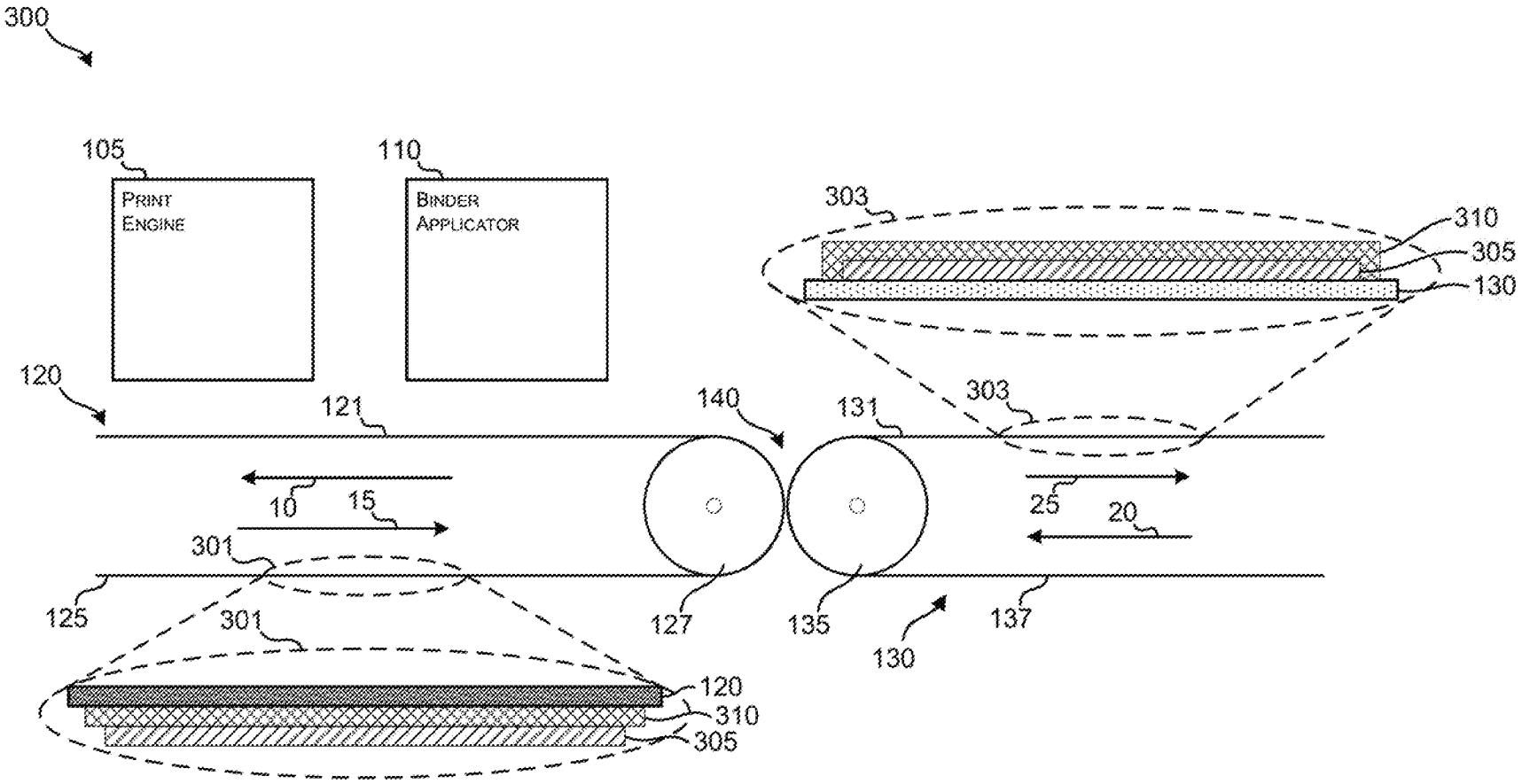
FIG. 3 depicts a detailed view of example intermediate transfer printing layers of a belt type intermediate transfer printing system.

FIG. 3 depicts detailed views of a particular example printing system 300. In particular, FIG. 3 depicts a view 301 of the layers of the intermediate transfer medium 120, the binder material 310, and the printing material 305. As described herein, the binder applicator 110 can first deposit a layer of binder material 310 on a surface of the intermediate transfer medium 120. Next, the print engine 105 can selectively apply patterns of printing material 305 on top of the layer of binder material 310. As the intermediate transfer medium 120 rotates about the rollers 123 and 127 in the directions indicated by arrows 10 and 15, the layers of printing material 305 and binder material 310 are rotated to be presented to the print medium 130 at the nip formed between the roller 127 and roller 135. By applying force and/or heat to the intermediate transfer medium 120, the binder material layer 310, the printing material layer 305, and the print medium 130 between the rollers 127 and 135, the binder material layer 310 and the printing material layer 305 can be transferred to the print medium 130.

As the binder material layer 310 and the printing material layer 305 are transferred to the print medium 130, the printing material layer 305 is proximate to the surface of the print medium 130 and the binder material layer 310 forms a durable coating over the layer of printing material 305 and the surface of the print medium 130. The resulting order of the material layers are depicted in detailed view 303. Of course, since the printing material layer 305 can be selectively applied in a pattern to form a printed image, the binder material layer 310 can be in direct contact with the surface of the print medium 130 and/or the layer of printing material 305. Accordingly, the binder material that was once in direct contact with the intermediate transfer medium 120 can now form a durable coating over the surface of the print medium 130 and the printing material layer 305 disposed thereon. The presence of the binder material 310 can help release from the intermediate transfer medium 120, and may also aid in adhering the printing material 305 to the surface of the print medium 130. In some implementations, the binder material can help protect and improve the durability of the printing material 305.

Figure 4:
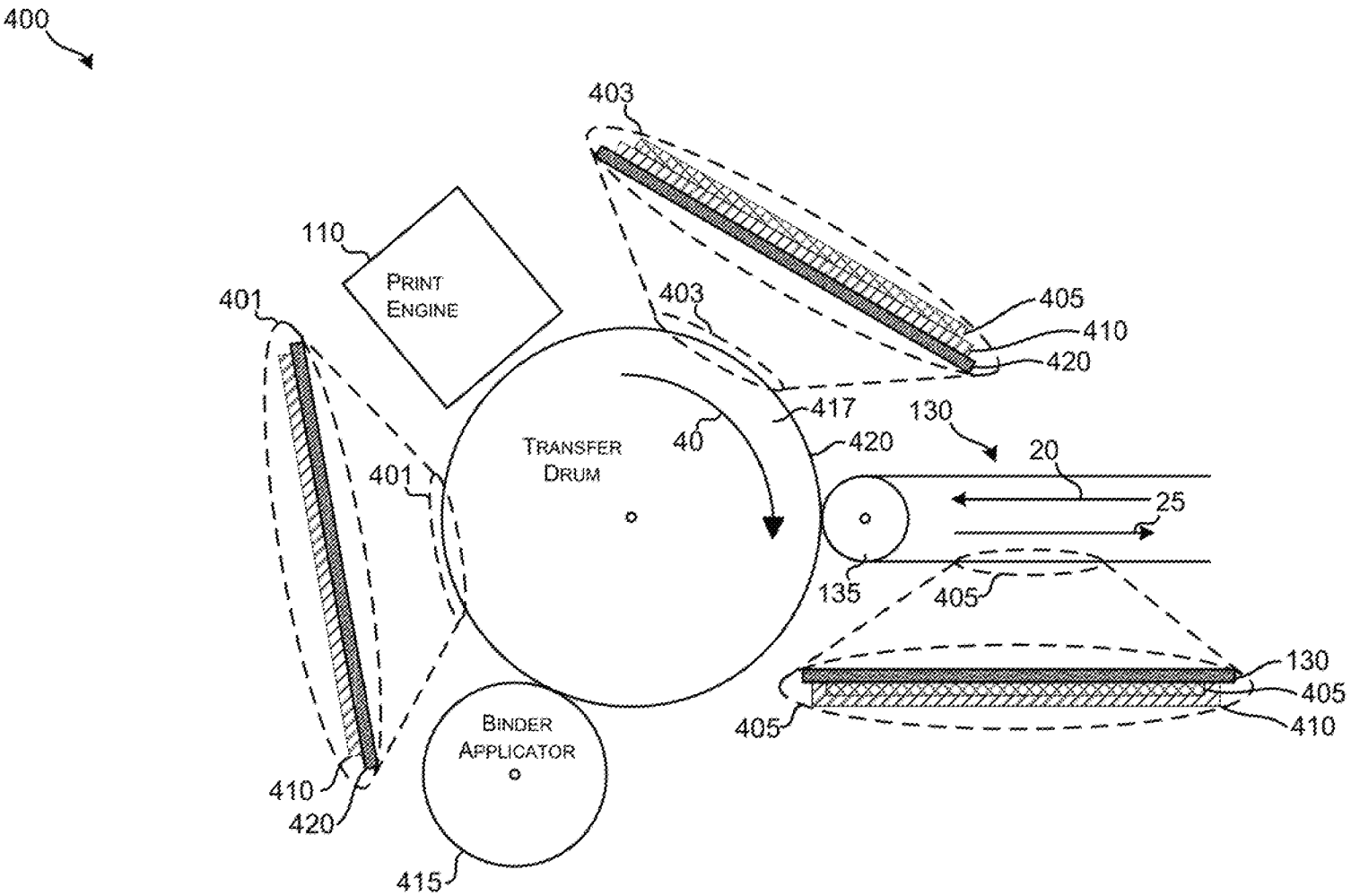
FIG. 4 depicts a detailed view of example intermediate transfer printing layers of a drum type intermediate transfer printing system.

FIG. 4 depicts another example printing system 400 according to various implementations of the present disclosure. In the particular example shown in FIG. 4, the intermediate transfer medium takes the form of a transfer drum 417. The transfer drum 417 can include any roller of any diameter that can rotate about an axis in the direction indicated by arrow 40. The external surface of the transfer drama 417 can include an intermediate transfer medium 420. In some implementations, the intermediate transfer medium 420 can include a band, strap, or layer disposed around the circumference of the transfer drum 417. The intermediate transfer medium 420 can include physical, chemical, or material characteristics similar to the intermediate transfer medium 120 band described above in reference to FIGS. 1 through 3.

As the transfer drum 417 rotates about its axis in the direction indicated by arrow 40, a binder applicator roller 415 can apply a layer of binder material 410. Detailed view 401 depicts the layer of binder material 410 disposed on the surface of the intermediate transfer medium 420 disposed on the external surface of the transfer drum 417. As the transfer drum 417 continues to rotate in the direction indicated by arrow 40, the print engine 110 can selectively apply printing material 405 on top of the layer of binder material 410. Detailed view 403 depicts the stack up of the printing material 405 on top of the layer of binder material 410 on top of the intermediate transfer medium 420 disposed on the transfer drum 417.

As the transfer drum 417 rotates, the printing material 405 and the binder material 417 are pressed against the print medium 130 between the intermediate transfer medium 420 on the transfer drum 417 and the roller 135. In this way, the printing material 405 and the binder material 410 are transferred to the print medium 130 as it travels along the directions indicated by arrows 20 and 25. Accordingly, as fresh surfaces of the print medium 130 arrive from the direction indicated by arrow 20, the surfaces move away from the transfer drum 417 in the direction indicated by arrow 25 with the printing material 405 disposed proximate to the surface of the print medium 130 and covered by the binder material 410. As described herein, the binder material layer 410 not only creates a durable layer over the surface of the print medium 130 and the printed image formed by the printing material 405, it may also help the printing material 405 adhere to the surface of the print medium 130.

Figure 5:
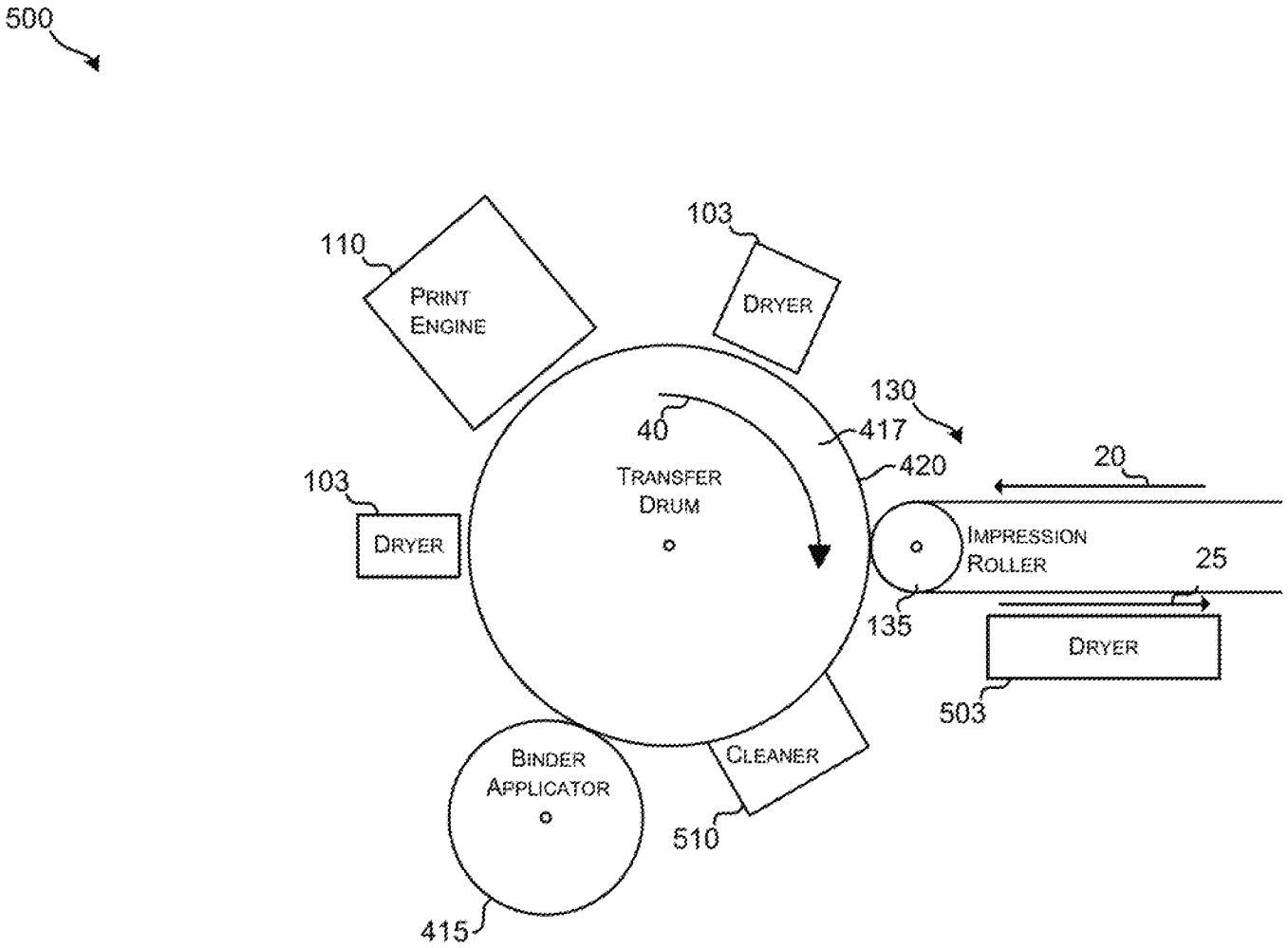
FIG. 5 depicts a schematic representation of an example drum type intermediate transfer printing system.

FIG. 5 depicts another example printing system 500 according to various implementations of the present disclosure. System 500 is similar to the system 400 of FIG. 4 and includes additional elements as shown. In particular, in addition to the components depicted in system 400, system 500 also includes a cleaner unit 510 and multiple dryers 103 and 503. Just as in system 400, the binder applicator 415 can apply a layer of binder material to the intermediate transfer medium 420 disposed on the transfer drum 417 as it rotates around its axis in the direction indicated by arrow 40. The first dryer 103 can dry or otherwise condition the layer of binder material before the print engine 110 selectively disposes printing material to generate a printed image. The second dryer 103 can further dry or condition the binder material and/or the printing material disposed by the binder applicator 415 and the print engine 110, respectively.

As the transfer drum 417 rotates, the layers of binder material and printing material are transferred from the intermediate transfer medium 420 to the print medium 130 as they are pressed together in the nip between the transfer drum 417 and the impression roller 135. As the printed print medium 130 departs the nip between the transfer drum 417 and the impression roller 135 in the direction indicated by arrow 25, an additional dryer 503 can further dry, condition and/or set the combination of the binder material and printing material on the surface of the print medium 130. As described herein, based on the order of the application of the binder material and the printing material to the intermediate transfer medium 420, the printing material is disposed on the surface of the print medium 130 and can be coated with or otherwise covered with a layer of the binder material.

After the binder material and the printing material is transferred to the print medium, the cleaner 510 can remove any residues that remain on the intermediate transfer medium. Such cleaning can help remove any residual materials that can reduce print quality or the useful life of the intermediate transfer medium 420.

Figure 6:
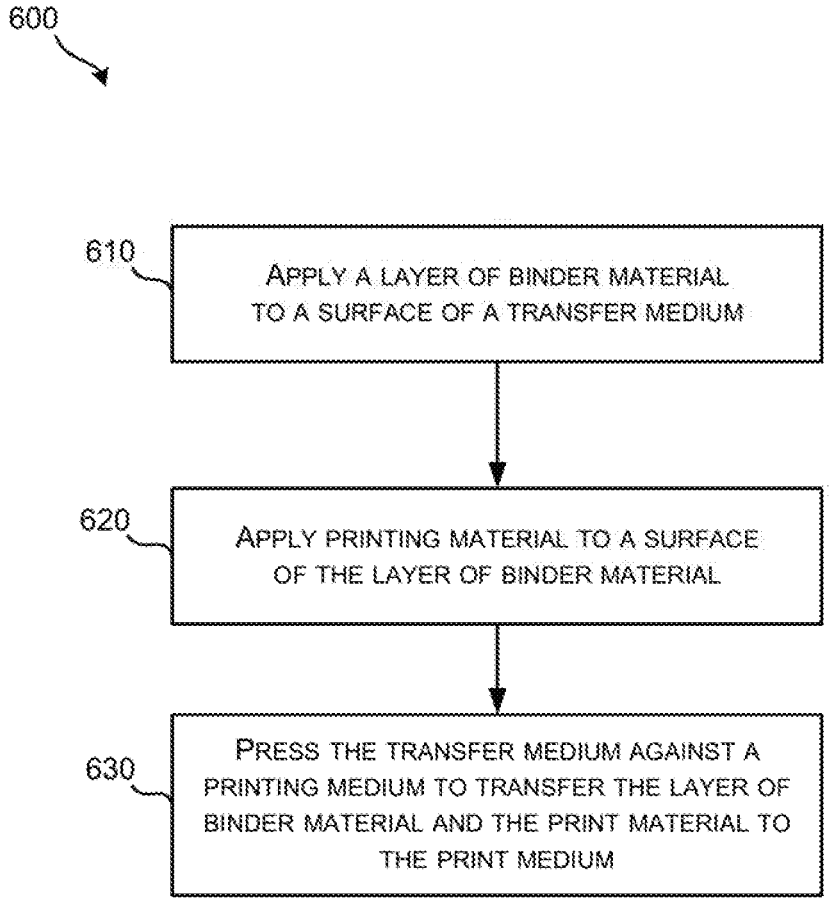
FIG. 6 is a flowchart of an example method for intermediate transfer printing.

FIG. 6 depicts an example method 600 according to various implementations of the present disclosure. The method can begin at box 610 in which binder applicator 110 or 410 applies a layer of binder material to a surface of a transfer medium. As described herein, the transfer medium can include any type of material that can accept a layer of binder material, allow for it to be conditioned and printed on, and then release it cleanly when pressed against a corresponding print media. In some implementations, the transfer medium can be a reusable layer, while in other implementations, the transfer medium can include a single use or disposable layer or film of plastic.

At box 620, a print engine can selectively apply printing material to a surface of the layer of binder material disposed on the transfer medium. The selective application of the printing material can form a printed image. Before, during, or after the application of the printing material to the surface of the layer binder material, the binder material and or the printing material can be dried and/or conditioned to a predetermined level of dryness or tackiness conducive for transfer to a print medium under corresponding conditions (e.g., pressure, temperature, or time).

At box 630, the transfer medium can be pressed against a print medium to transfer the layer of binder material and the printing material to the print medium. Pressing the transfer medium against the printing medium can include passing the transfer medium on which the binder material and printing material are disposed against the print medium between corresponding rollers and/or drums. Upon pressing the transfer medium on which the binder material and printing material are disposed, the combination of the binder material and the printing material are transferred to the print medium such that the printing material is disposed against the surface of the print medium. In such processes, the binder material can aid in adhering the printing material to the print medium and/or form a protective coating layer over the printing material.

Any or all of the actions of the above described implementations can be performed by any number of apparatuses or devices in various corresponding separate processes. For example, the application of the binder material to the surface of the transfer medium can occur in processes performed on one device. In particular, the application of the binder material can be applied to a plastic or polymeric film type transfer medium that is received from a roll of the film material. The transfer medium can then be re-rolled and taken to another process or device, such as printer or print press, where the printing material is applied to the surface of the binder material on the transfer medium (e.g., the plastic film). At this point, the transfer medium which has now been treated with binder material and printed on using printing material can be re-rolled for later use. Alternatively, the printed transfer medium can be feed directly into a transfer mechanism where it can be pressed onto a print medium to transfer the printing material and binder material to generate a durable printed image. Such separate process can allow for various aspects of the present disclosure to be implemented in existing devices, such as printers, printing presses, or finishing devices.

These and other variations, modifications, additions, and improvements may fall within the scope of the appended claims(s). As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. A printing system comprising:

a transfer medium;

a binder material applicator to apply a layer of binder material to a surface of the transfer medium;

a print engine to apply printing material to the layer of binder material; and a roller to press the transfer medium against a print medium to transfer the binder material and the printing material to the print medium.

2. The printing system of claim 1 wherein the printing material is disposed proximate a surface of the print medium and the binder material forms a protective layer over the printing material.

3. The printing system of claim 1 wherein the transfer medium comprises a durable reusable belt.

4. The printing system of claim 1 wherein the transfer medium is disposed on a rotatable drum.

5. The printing system of claim 1 wherein the transfer medium comprises a single use film.

6. The printing system of claim 5 further comprising a single use film supply to provide the single use film.

7. The printing system of claim 6 wherein the single use film supply comprises a film extruder.

8. The printing system of claim 1 further comprising a dryer to condition the binder material or the printing material before, during, or after transfer of the binder material and the printing material from the transfer medium to the print medium.

9. The printing system of claim 1 wherein the print engine comprises an inkjet print element to selectively apply the printing material to form a printed image on the layer of binder material.

10. A method comprising:

forming a layer of binder material to a surface of a transfer medium;

applying printing material to the layer of binder material; and transferring the printing material and the binder material from the transfer medium to a print medium.

11. The method of claim 10 further comprising conditioning the binder material or the printing material before, during, or after the transferring.

12. The method of claim 11 wherein the conditioning comprises applying a heating treatment.

13. The method of claim 10 wherein applying the printing material to the layer of binder material comprises selectively printing the printing material to form a printed image.

14. The method of claim 10 wherein transferring the printing material and the binder material comprises pressing the transfer medium against the print medium.

15. The method of claim 10 wherein the printing material is disposed proximate a surface of the print medium and the binder material forms a protective layer over the printing material.

* * * * *